US006076703A

United States Patent [19]

Kuil et al.

[11] Patent Number: 6,076,703

[45] Date of Patent: Jun. 20, 2000

[54] DISPENSING DEVICE AND CONTAINER ASSEMBLY COMPRISING SUCH DEVICE

[75] Inventors: Jan Kuil; Lambertus Gerardus van der Heijden, both of Maarssen, Netherlands

[73] Assignee: Diversey Lever, Inc., Plymouth, Mich.

[21] Appl. No.: 09/177,680

[22] Filed: Oct. 22, 1998

[30] Foreign Application Priority Data

Nov. 5, 1997 [EP] European Pat. Off. ..... 97203426

[51] Int. Cl.[7] ..... B67D 5/32

[52] U.S. Cl. ..... 222/39; 222/51; 222/52; 116/110; 137/558

[58] Field of Search ..... 222/23, 39, 51, 222/64, 67, 1, 52; 116/228, 110; 73/308, 313, 319; 137/558

[56] References Cited

U.S. PATENT DOCUMENTS 3,242,474 3/1966 Gast et al. ..... 222/51
3,541,283 11/1970 Milo ..... 222/51 X
4,116,128 9/1978 Lehmqnn et al. ..... 222/67 X
4,560,089 12/1985 McMillin et al. ..... 222/67 X
4,714,176 12/1987 Wijnen ..... 222/51
5,150,614 9/1992 Urich ..... 73/308

FOREIGN PATENT DOCUMENTS 1002597 9/1997 Netherlands .

*Primary Examiner*—Kevin Shaver
*Assistant Examiner*—Thach H. Bui

[57] ABSTRACT

The invention relates to a device coupled to a fluid container. The device contains a fluid inlet and a fluid outlet and is capable of dispensing fluid into the fluid container. The device also contains an alarm to warn a user that the container is substantially empty.

10 Claims, 3 Drawing Sheets

DISPENSING DEVICE AND CONTAINER ASSEMBLY COMPRISING SUCH DEVICE

The present invention relates to a device for dispensing fluid from a container, to a container assembly comprising such and to a method for warning as to the emptiness of a fluid container.

Fluid substances such as dangerous chemicals are transported in large containers, such as metal jerry cans, from where such fluid is dispensed. There exists a need for dispensing fluid from such containers in such a way that substantially no spillage occurs on dispensing thereof or on exchanging a depleted container for a full one. Furthermore, a problem with existing containers, is that the user is often unaware as to the amount of remaining fluid in the container, whereby when the container is empty a replacement full container is often not available since this has not been ordered in time.

An object of the present invention is to provide a device which substantially overcomes one or more of the above problems.

According to a first aspect of the present invention, there is provided a device coupleable to a fluid container, said device for dispensing fluid within the container, said device comprising:

a fluid inlet;

a fluid outlet;

coupling means for substantially, non leakably coupling the device to a fluid container; and alarm means for alarming a user that the container is substantially empty of fluid.

The present invention accordingly provides a device which enables fluid to be safely dispensed from containers, substantially without leakage, whereby the device is able to be removed from an empty container and replaced in position on a full container also substantially without leakage, and whereby a user is made aware of the fact that the container is empty by the device alarm.

Further desired features are referred to in the description below.

According to a second aspect of the present invention there is provided an assembly comprising the above device and a liquid container, to which the device is coupled for storing liquid.

According to a third aspect of the present invention there is provided a method for warning as to the emptiness of a fluid container, comprising coupling the above device to a fluid container, causing fluid to flow through the device from the container until the level of the fluid within the device reaches a predetermined level, whereby the device alarm is activated.

Figure 1:
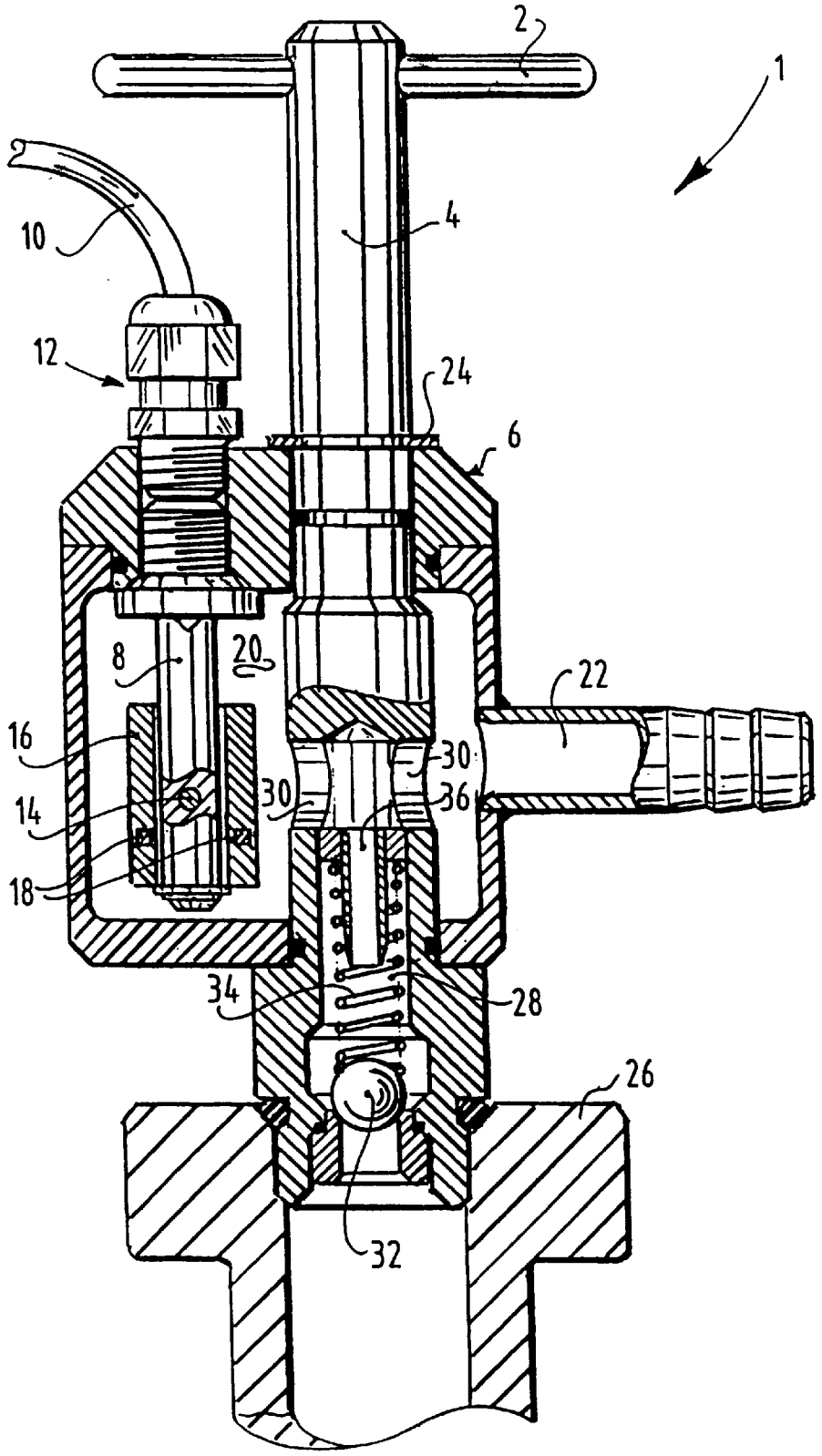
Figure 3:
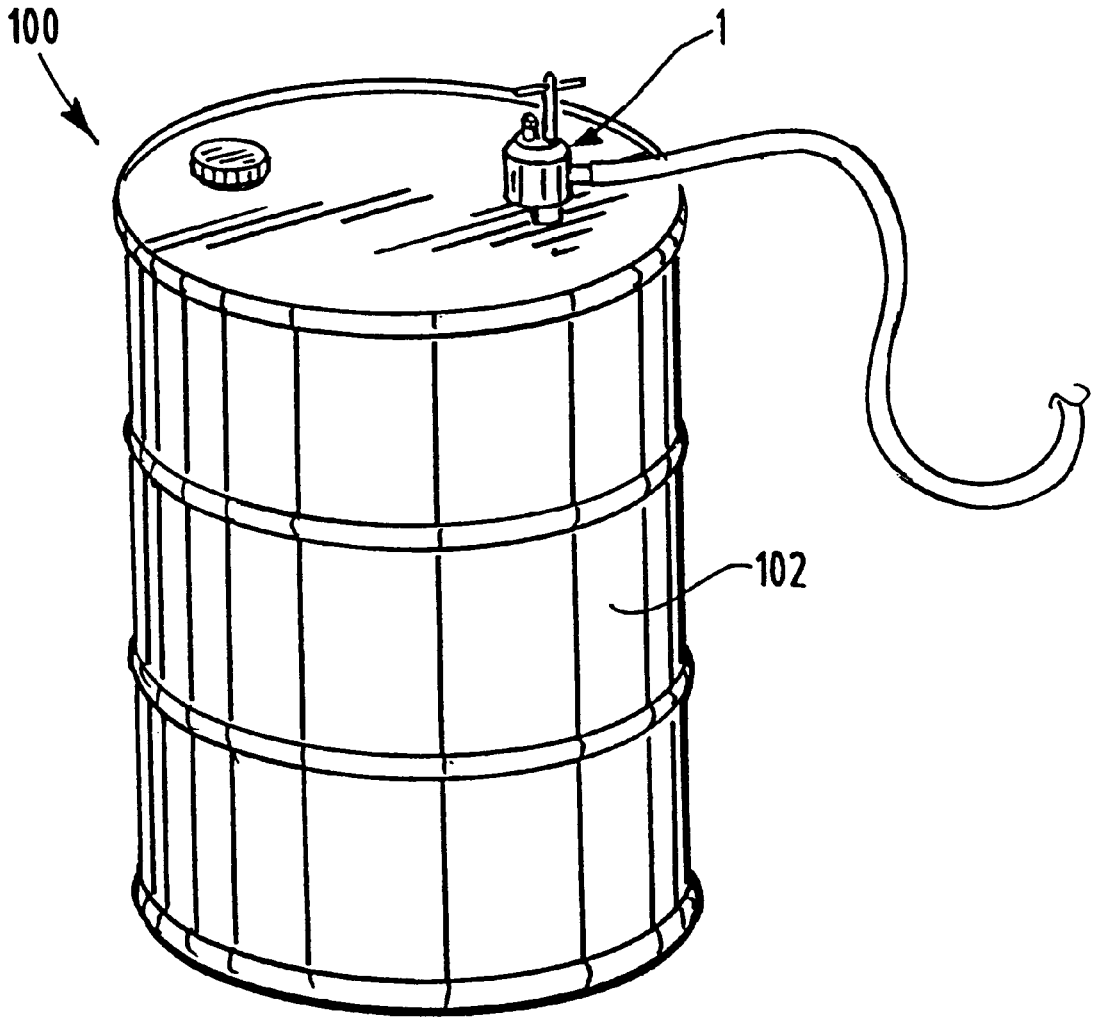

The invention will now be described by way of the following description which refers to the figures, wherein:

FIG. 1 shows a partially cut away axial cross-section of a first embodiment of the device according to the present invention;

FIGS. 2*a*–2*d* show axial cross-sections of a side view of a second embodiment of the device according to the present invention in different working positions;

FIG. 3 shows a perspective view of an assembly according to the present invention.

A device 1 (FIG. 1) is provided with a handle 2 connected to a metal turn-rod 4 which extends through a housing 6. A sensor 8 connected to an electrical alarm circuit by means of cable 10 is fixed in the housing 6 by means of the nut-bolt arrangement 12. This sensor 8 is a switch 14, operated by the presence or absence of a magnetic field. A cylindrical float 16 is arranged around the sensor 8 to be vertically displaceable thereover.

A ring-magnet 18 is housed within the float 16. The ring-magnet 18, float 16 and sensor 8 are together known as a level switch.

The sensor 8 and float 16 are situated in a fluid chamber of the device 1.

A feed tube 22 extends from the housing 6 and is connectable to a pump tube (not shown).

The metal-rod 4 co-operates with the housing 6 to enable said bar 4 to rotate therein. A seal ring cap 24 is provided around the metal rod 4 at the junction with the housing 6.

The lower end of the metal rod 4 is screwed into a down tube 26 of a container by means of a screw thread (not shown) for co-operating with a corresponding screw thread arranged at the opening of the down tube 26.

The lower part of the metal rod 4 is provided with a bore 28 which opens out at openings 30 into the chamber 20 and the feed tube 22.

A spring loaded non-return ball valve 32 is housed in the central bore 28, in association with a compression spring 34.

In use, the device 1 is firstly fixed into the opening of the down tube 26.

When a pump is connected to the feed tube 22 and turned on, an an underpressure forces the non return ball valve 32 upwards to allow fluid to flow through the bore 28 and a narrower bore-channel 36 continuous therewith, and into the feed tube 22 and chamber 20 through the openings 30.

When the chamber 20 is full of liquid, the float 16 is so displaced around the stationary sensor 8, that the ring-magnet 18 is situated above the switch 14.

When the pump is switched off, the ball valve 32 closes to stop fluid being dispensed. Fluid is held in the chamber 20 whereby the ring-magnet 18 floats above the switch 14.

When the container is empty, air is sucked into the chamber 20, whereby the float 16 drops around the sensor 8, whereby the magnetic field in the region of the switch 14 increases due to the proximity of the ring-magnet 8 in order to break the circuit and cause an alarm, arranged in the circuit, to be effected, thereby making the user aware of the emptiness of the container.

It will be realized that the circuit can be so arranged, that the alarm is effected by either completing or breaking the circuit.

This embodiment of the present invention is specifically designed to be used with large metal containers, for example 200 liter chemical containers.

The second embodiment of the device 50 (FIGS. 2*a*–*d*) is provided with a feed-tube 52 which opens into a chamber S41 wherein a fixed sensor arrangement depends, which is provided with two independent switches 58 and 60.

These switches 58 and 60 are mounted in two sensors 56 and 57 which are connected to one another by an insulating connecting piece 62. A cylindrical float 64 is arranged in the chamber 54 around the sensor 56. This float 64 houses a ring magnet 66. The switches form part of an alarm circuit (not shown) and are connected thereto by cable 69. The sensor 57 extends into a narrower middle section 68 of a housing 67 of the device. When the chamber 54 is empty (as in FIG. 2*a*), the float 64 rests on shoulders 70 of the housing 67 when the device is in an upright position.

The middle section 68 of the housing is continuous with a narrower bore channel 74 which terminates in a closed end 76. Openings 77 are arranged near this end 76.

A displaceable sleeve 72 covers the openings 77 when the device is not connected with a container. This embodiment of the device according to the present invention is designed to couple with a female coupling, such as described in EP 0 270 302.

A spring 79 is arranged between shoulders 75 of the sleeve 72 and a neck 78 of the middle-section 68 of the housing 67.

A ring-magnet 80 is arranged in a terminal perimeter of the sleeve 72.

An outer-casing 82 is associated with lugs 84, coupleable to the corresponding female coupling part (not shown) of the container 86.

Figures 2A, 2B, 2C, 2D:
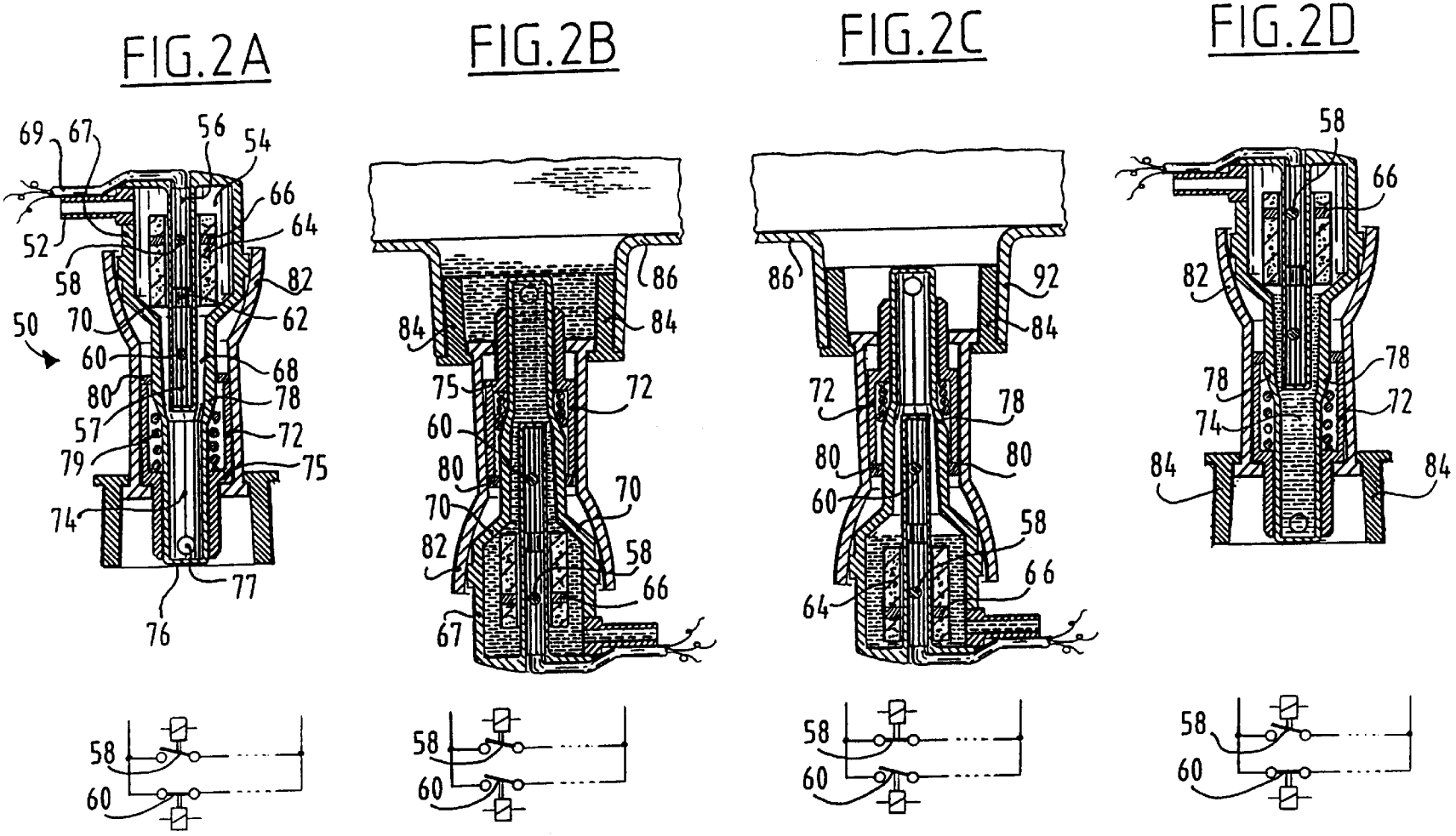

In FIG. 2*a* the device is disconnected with a container and there is no resident fluid in the chamber.

In this position, the ring-magnet 80 does not activate the switch 60, although ring-magnet 66 activates switch 58 to open the latter.

On coupling the device to a container, having a volume of 50–70 L for example, the sleeve 72 is pushed upwards over the bore channel 74, thereby compressing the spring 79, whereby the openings 77 are uncovered, so that fluid flows from the container, through these openings 77, up into the channel 74 and into the chamber 54 and out of the feed pipe 52 (see FIG. 2*a*), when the latter is connected to a pump. On connecting the device 50 to the co-operable female member (not shown), the sleeve 75 is forced upwards by the female member, thereby compressing the spring 78 and bringing the ring-magnet 80 into the vicinity of switch 60, whereby this switch is also activated (FIG. 2*b*). In exclusively this position when both switches are activated, i.e. open, there is no alarm. Accordingly, activation of switch 60 only occurs when the device is actually coupled to a container, and activation of switch 60 occurs when the chamber 54 is filled with liquid whereby the float 64 is displaced, so that ring magnet 66 resides in the vicinity of the switch 58, whereby the latter is activated (see FIG. 2*b*). Accordingly, this embodiment of the invention provides two switches which are independently activateable. As with the first embodiment described above, it will be realized that the circuit can be so arranged that the alarm is effected by either opening or closing both the switches. When the container is empty, FIG. 2*c*, the device being however still connected, switch 60 remains activated, but since switch 58 is de-activated, i.e. the level of liquid in the alarm chamber 54 not being such that the float 64 brings the magnet 60 into the activating region of the switch 58, switch 58 is de-activated, closed, whereby an alarm sounds.

On decoupling the device 50 (FIG. 2D) from the container, but in the situation where an amount of fluid still resides in the chamber thereof, it is necessary that the alarm still registers, or else it could be assumed, that even though the coupling has been disconnected, there is still fluid left in the container.

As such on decoupling, the spring 78 forces the sleeve 72 back down over the end of the bore 74, thereby closing the openings 77, whereby leakage is prevented, and removing the magnet 80 from the vicinity of the switch 60, thereby causing the alarm.

It will be seen that this embodiment of the invention can be used whatever its connection orientation with respect to a container.

Furthermore, the sensor arrangement comprising the two sensors 56, 57 the connecting piece 62 and the switches 58, 60, can be easily removed/replaced as a unit without having to dissassemble the whole device.

An assembly 100 (FIG. 3) according to the present invention comprises a jerry can container 102 whereupon the dispensing-alarm-device 1 is arranged.

The present invention is not limited to the above described embodiments; the requested rights are rather determined by the following claims.

What is claimed is:

1. Device coupleable to a fluid container, said device for dispensing fluid within the container, said device comprising:

a fluid inlet;

a fluid outlet;

coupling means for substantially, non leakably coupling the device to a fluid container; and alarm means for alarming a user that the container is substantially empty of fluid, said alarm means comprising a first and second switch arranged in a fluid fillable chamber, the first switch being activated by a switch activating means comprising a spring that activates the first switch when the device is coupled to the container, and the second switch being activated by a switch activating means comprising a float that activates the second switch when the chamber is filled.

2. Device according to claim 1, wherein the switch activating means and/or the switches are displaceable, whereby in a first mutual position, the switches are activated and whereby in a second mutual position the switches are inactivated.

3. Device according to claim 1, wherein the switch activating means comprise a magnet.

4. Device according to claim 3, wherein the magnet is housed in a float arrangement, floatable in the liquid contained within the container.

5. Device according to claim 1, wherein the switch activating means comprises a magnet arranged within a displaceable device part.

6. Device according to claim 1, wherein the device further comprises a chamber that is arranged substantially in line with the coupling means.

7. Device according to claim 1, wherein the device further comprises a chamber that is laterally displaced from the coupling means.

8. Device according to claim 1, further comprising a valve for controlling the flow of liquid through the device.

9. Assembly comprising a device according to claim 1, coupled to a container, for storing fluid.

10. Method for warning as to an emptiness level of a fluid container, comprising coupling a device according to claim 1 to a fluid container, and causing fluid to flow through said device from the container until the level of fluid within the device reaches a predetermined level whereby the device alarm means is activated.

* * * * *